US006895201B2

(12) United States Patent
Kaiho

(10) Patent No.: US 6,895,201 B2
(45) Date of Patent: May 17, 2005

(54) METHOD AND APPARATUS FOR REFILLING A TONER SUPPLY IN A PREDETERMINED ORIENTATION

(75) Inventor: Satoshi Kaiho, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/679,313

(22) Filed: Oct. 7, 2003

(65) Prior Publication Data

US 2005/0074261 A1 Apr. 7, 2005

(51) Int. Cl.[7] ..... G03G 15/00
(52) U.S. Cl. ..... 399/258
(58) Field of Search ..... 399/258, 262, 399/120

(56) References Cited

U.S. PATENT DOCUMENTS 6,195,521 B1 * 2/2001 Nozawa et al. ..... 399/262

FOREIGN PATENT DOCUMENTS

JP 3073042 B2 6/2000
JP 2003-98811 A 4/2003

* cited by examiner

*Primary Examiner*—Quana Grainger
(74) *Attorney, Agent, or Firm*—Foley & Lardner LLP

(57) ABSTRACT

An image forming apparatus is provided including a toner supply receiver and an image formation unit configured to form an image on an image-transferring member using toner from the toner supply receiver. The toner supply receiver preferably has an opening configured to receive a toner bottle, and a base portion having a receiver coupling configured to releasably retain the toner bottle. The base portion further includes an inner wall including an insertion guide surface configured to cause rotation of the toner bottle relative to the base portion as the toner bottle is inserted into the toner supply receiver to thereby align the toner bottle with the receiver coupling in a predetermined manner.

21 Claims, 4 Drawing Sheets

402
200
230
III
IV

METHOD AND APPARATUS FOR REFILLING A TONER SUPPLY IN A PREDETERMINED ORIENTATION

BACKGROUND OF THE INVENTION

A. Field of the Invention

The invention relates generally to image forming apparatuses such as photocopiers, facsimile machines, and printers, and, more particularly, to a method and apparatus for refilling a toner supply in an image forming apparatus.

B. Background of the Invention

Photocopiers, facsimile machines, and laser printers for printing images using toner are well known. One such apparatus is described in Japanese Publication No. 2003-098811 (hereinafter "JP '811"), and is incorporated by reference herein in its entirety. JP '811 discloses an image forming apparatus having a rotating toner bottle configuration, where a refillable/replaceable toner bottle is rotated within and relative to the image forming apparatus during the image forming process. Of course, many other configurations are also plausible, as would be readily apparent to one of ordinary skill in the art after reading this disclosure.

As understood, when the toner bottle becomes spent, it must be replaced by inserting a new/refilled toner bottle in its place. To facilitate proper alignment of the new/refilled toner bottle within the image forming apparatus (e.g., a toner opening in the toner bottle with a receiving opening in the image forming apparatus), rotation of the spent toner bottle may be stopped in a predetermined orientation relative to the image forming apparatus, such as having a receiving portion of the image forming apparatus in a top dead center position. The spent toner bottle can be removed, and a new toner bottle can be inserted by aligning the new toner bottle in a corresponding top dead center position.

Various potential problems exist, however, with the above described configuration. For example, if the power supply to the image forming apparatus unexpectedly stops, the spent toner supply bottle may not stop in the predetermined orientation. Similarly, should the orientation change after rotation is stopped (e.g., an operator unintentionally rotates the assembly when removing the spent toner bottle), the orientation will not be in the predetermined orientation. As such, the operator will not know the proper orientation for inserting the new toner bottle. Thus, a need exists for an image forming apparatus having an improved method and apparatus for refilling a toner supply therein.

SUMMARY OF THE INVENTION

According to one embodiment of the present invention, an image forming apparatus is provided including a toner supply receiver and an image formation unit configured to form an image on an image-transferring member using toner from the toner supply receiver. The toner supply receiver preferably has an opening configured to receive a toner bottle, and a base portion having a receiver coupling configured to releasably retain the toner bottle. The base portion further includes an inner wall including an insertion guide surface configured to cause rotation of the toner bottle relative to the base portion as the toner bottle is inserted into the toner supply receiver to thereby align the toner bottle with the receiver coupling in a predetermined manner.

According to another embodiment of the present invention, a method of refilling toner in a toner supply receiver in an image forming apparatus is provided, the toner supply receiver including a base portion for receiving a toner bottle, the base portion including an inner wall having an insertion guide surface. The method preferably includes steps of inserting the toner bottle into the base portion, while the toner bottle is being inserted into the base portion, sliding the toner bottle along the insertion guide surface to cause the toner bottle to rotate relative to the base portion and align the toner bottle relative to the base portion in a predetermined manner, and releasably coupling the toner bottle to the base portion.

According to another embodiment of the present invention, an image forming apparatus is provided including means for aligning a toner bottle being inserted into a toner supply mechanism, means for releasably coupling the toner bottle to the toner supply mechanism, and means for forming an image on an image-transferring member using toner from the toner supply mechanism. Preferably, the means for aligning rotates the toner bottle relative to the toner supply mechanism during insertion of the toner bottle, and includes a guide surface.

Further features, aspects and advantages of the present invention will become apparent from the detailed description of preferred embodiments that follows, when considered together with the accompanying drawing figures.

DETAILED DESCRIPTION OF EXEMPLARY EMBODIMENTS

Reference will now be made in detail to presently preferred embodiments of the invention. Wherever possible, the same reference numbers will be used throughout the drawings to refer to the same or like parts.

Figure 1:
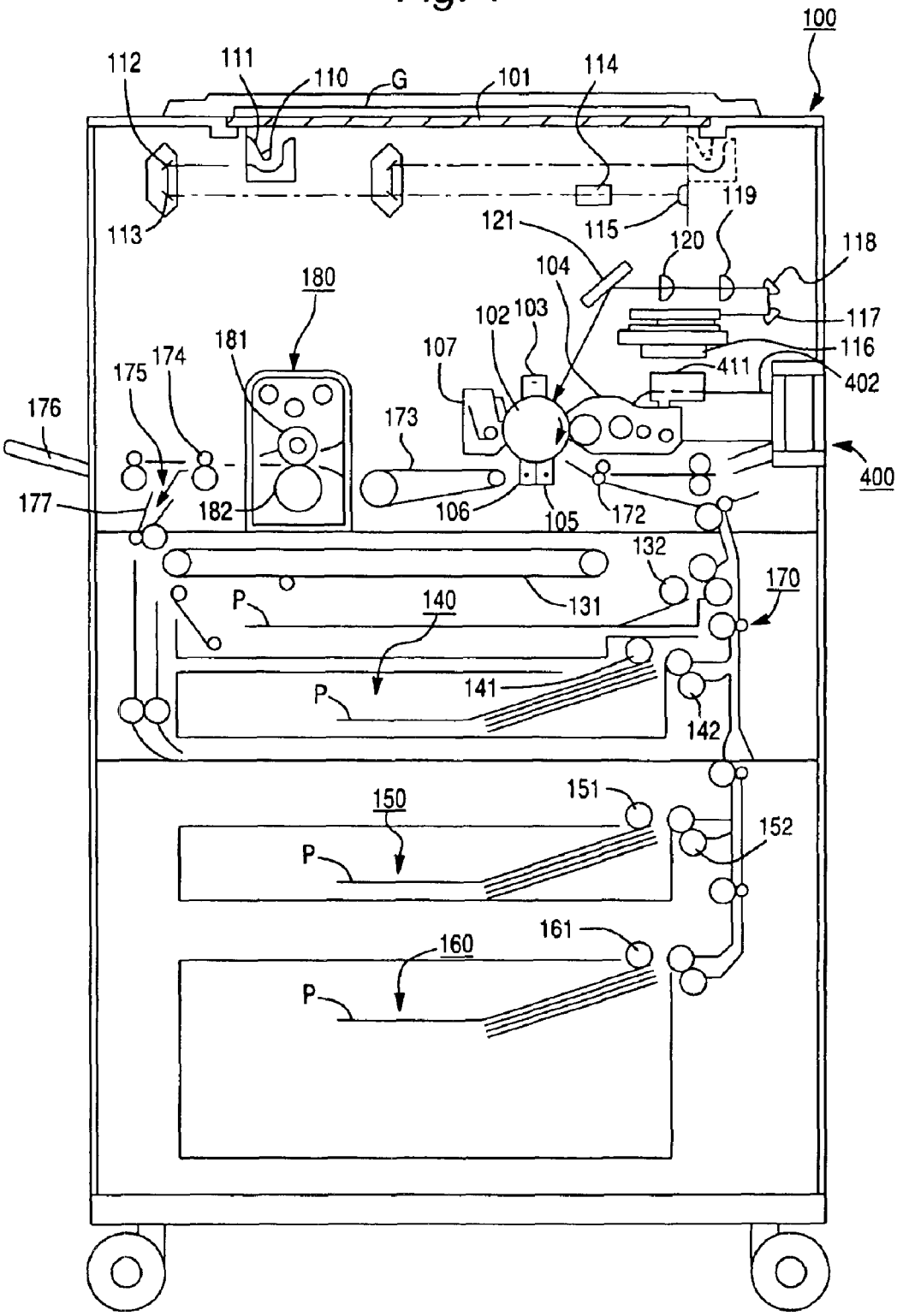
FIG. 1 is a block diagram of an image forming apparatus equipped with a toner supply unit according to an embodiment of the present invention.

An exemplary image forming device 100 equipped with a toner supply unit 400 according to various embodiments of the present invention is depicted in FIG. 1. The image forming device 100 includes a document table 101 on which a media G to be imaged can be positioned. The media G is then scanned by an exposure lamp 110, using mirrors 111–113, an image formation lens 114, and a charge couple device (CCD) 115. Other configurations are also plausible, such as including an automatic feeding station (not shown), etc.

Feed units 130, 140, 150 and 160 may be used to supply one or more media P (e.g., media P of differing sizes, types, and/or orientations) to a photo conductor 102 for image formation thereon. By way of example, if feed unit 140 is chosen, feed roller 141 extracts and transfers media P from a storage bin to a conveyance roller 142. Conveyance roller 142 then transfers the media P via a path 170 to a resist roller 172, which, in turn, positions the media P relative to photo conductor 102. Similar configurations can be used for feed unit 130 (with feed roller 131) and for feed units 150 and 160 (via a path 152, using feed rollers 151 and 161 respectively).

An electrification unit 103, a development counter 104, an imprint unit 105, an eliminator 106, and a cleaning unit 107 are arranged at a periphery of photo conductor 102 for imaging media P with a digital image obtained from the scan of media G described above. In particular, the digital image is superimposed by a laser beam used to scan photo conductor 102. By way of example, photo conductor 102 can be scanned using a laser beam manipulated using a polygon mirror 116, and reflected by mirrors 117, 118, 121 onto photo conductor 102 after passing through lenses 119, 120. The scanned photo conductor 102 then applies toner from toner supply unit 400 onto media P, toner supply unit 400 including a base 411 coupled to toner bottle 402.

Once imprinted with the image by photo conductor 102, the media P is transferred to a fixing assembly 180 by a transport device 173. Fixing assembly 180 may include a heating roller 181 and a pressurization roller 182, for fixing the image onto media P. A guide roller 174 then selectively transfers, using a selector 175, the media P to a tray 176 if a single side copy is performed, or to a double side path 177 if a double side copy is performed. Other configurations are also plausible, as would be readily apparent to one of ordinary skill in the art after reading this disclosure. The present embodiment contemplates any known overall configuration of the image forming apparatus.

Figures 2, 2A, 2B, 2C, 2D:
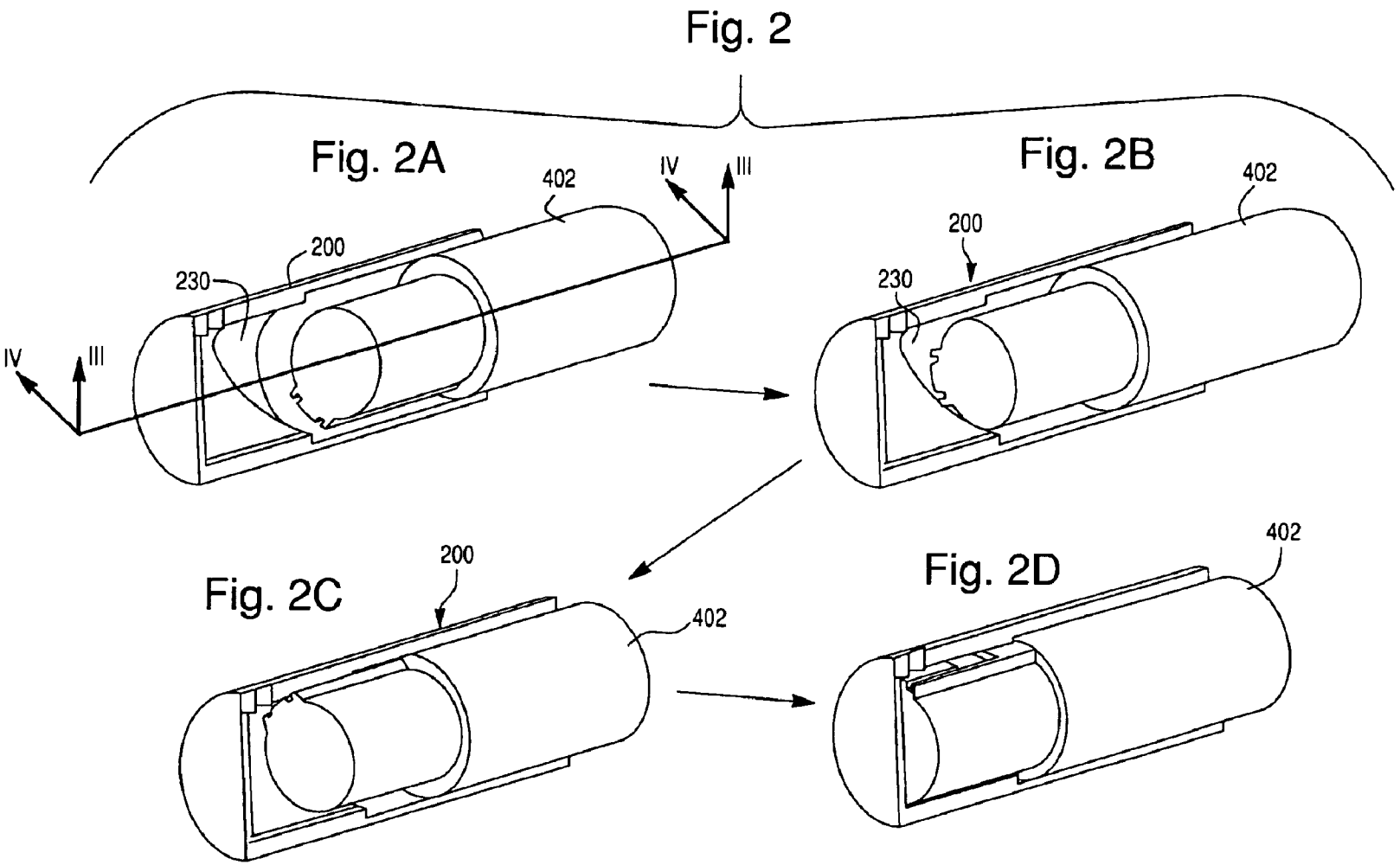
FIGS. 2A–2D show a partially cut-away view of a toner supply receiver with a toner bottle being inserted therein according to an embodiment of the present invention.
Figure 3:
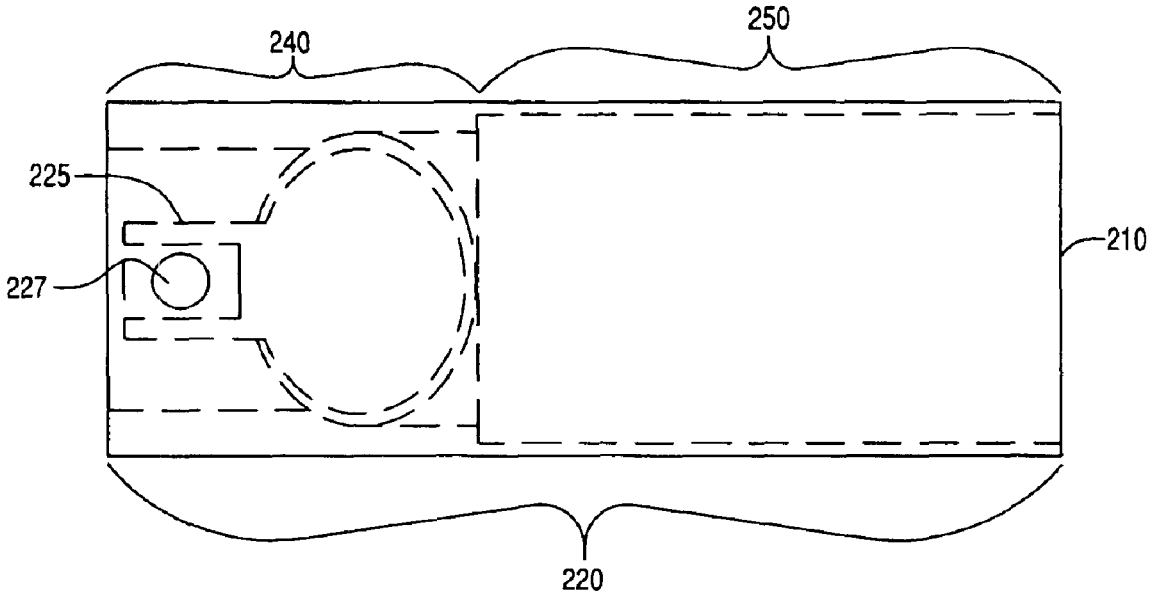
FIG. 3 shows a sectional view of the toner supply receiver of FIGS. 2A–2D along axis III—III.
Figure 4:
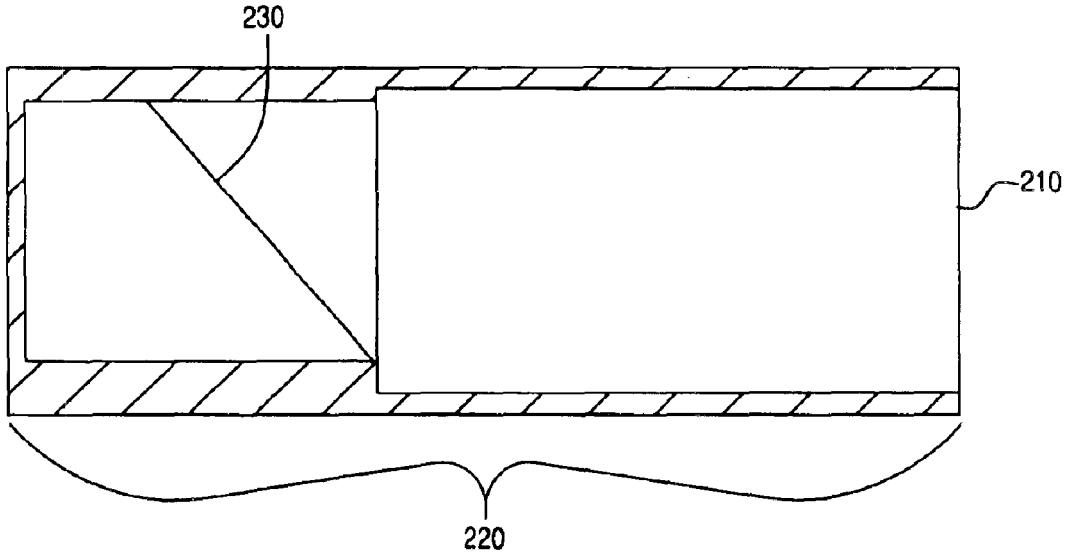
FIG. 4 shows a sectional view of the toner supply receiver of FIGS. 2A–2D along axis IV—IV.
Figure 5:
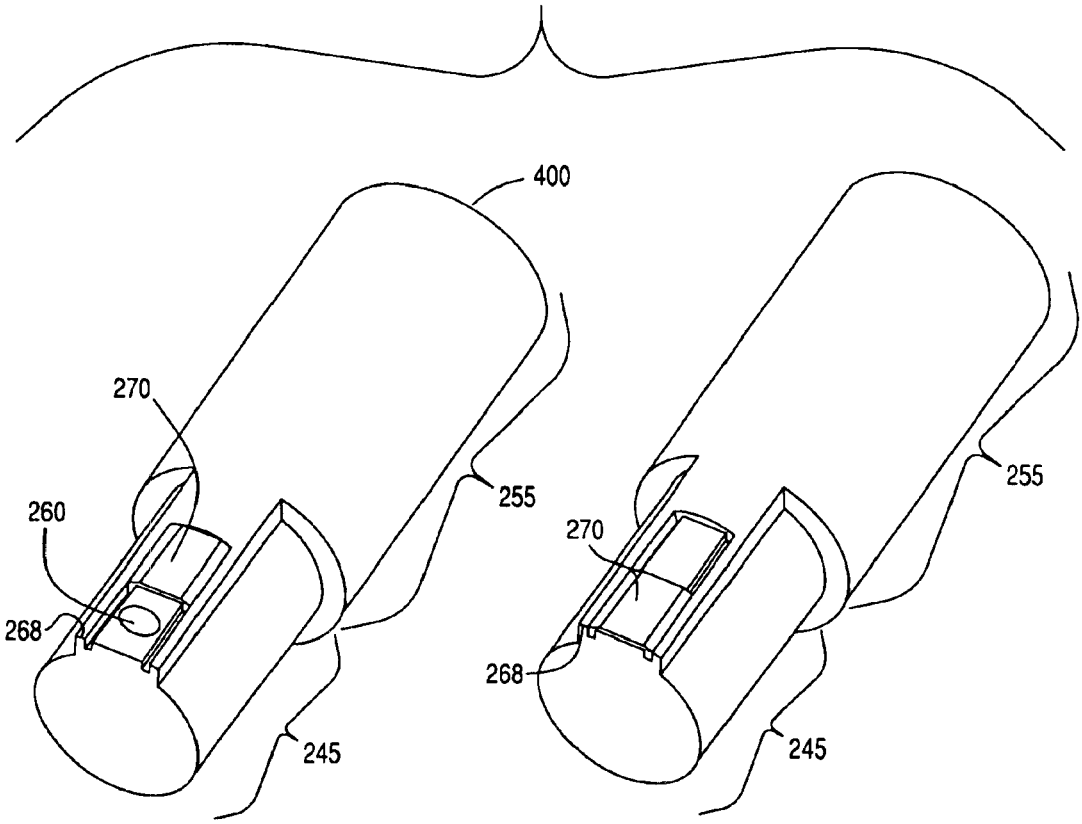
FIG. 5 shows a toner bottle according to an embodiment of the present invention.

FIGS. 2–4 depict a toner supply unit configured to releasably retain a toner bottle 402 (preferably within the image forming device described above) according to an embodiment of the present invention. The toner supply unit has a toner supply receiver 200 configured to releasably retain toner bottle 402 therein. The toner supply receiver 200 includes an opening 210 configured to receive toner bottle 402, and a base portion 220 having a receiver coupling 225 configured to releasably retain toner bottle 402. The base portion 220 preferably includes a receiving portion 240 and a holding portion 250, for interfacing with a first portion 245 and a second portion 255 respectively of toner bottle 402 (see FIG. 5). The receiving portion 240 may have a smaller diameter than holding portion 250 as shown in the figures, depending on the particular implementation at hand.

The base portion 220 further includes an inner wall with a guide surface, here shown as a slanted surface 230, that causes the toner bottle 402 to rotate relative to the base portion 220 when the toner bottle 402 is inserted into the toner supply receiver 200. In this manner, the first portion 245 of toner bottle 402 is aligned with the receiving portion 240 of the toner supply receiver 200, such that a toner opening 260 of toner bottle 402 aligns with a receiving opening 227 of toner supply receiver 200. While slanted surface 230 is shown, as indicated, other guide surfaces are also contemplated, such as a grooved surface.

The general insertion and alignment process is shown in greater detail in FIGS. 2A–2D, where FIG. 2A depicts toner bottle 402 beginning to be inserted into toner supply receiver 200. As the toner bottle 402 is gradually inserted into the toner supply receiver 200, a toner bottle projection 268 (see FIG. 5) engages the slanted surface 230 of the inner wall. The shape of the slanted surface 230 with this engagement causes the toner bottle 402 to rotate in a clockwise direction (though a counter-clockwise configuration could certainly be employed) as shown in FIGS. 2B and 2C, until the first portion 245 of the toner bottle 402 engages the receiving portion 240 of the toner supply unit 200 as shown in FIG. 2D. With this insertion process, the toner opening 260 of toner bottle 402 automatically aligns itself with receiving opening 227 of toner supply receiver 200.

According to one embodiment of the present invention, the slanted surface 230, which may have a constant depth, may have a depth corresponding to a height of the toner bottle projection 268. This depth-to-height relationship provides a relatively snug or tight fit for the toner bottle 402 as it is inserted into the toner supply receiver 200. If the slanted surface has a varying depth, its largest depth may correspond to the height of the toner bottle projection 268. Additionally, the slanted surface 230 preferably extends for a length along the inner wall sufficient to rotate the toner bottle 402 at least 45 degrees. Other lengths for slanted surface 230 are also contemplated, including lengths along the inner wall sufficient to rotate the toner bottle 402 at least 90 degrees, or at least 180 degrees. Preferably, the slanted surface 230 has a length along the inner wall that will rotate the toner bottle 402 less than 360 degrees, to permit toner bottle 402 to be inserted in any rotational position relative to the opening 210 and causing the toner bottle to ultimately be aligned correctly when inserted.

It should be appreciated that the aforementioned heights and lengths of the slanted surface 230 (in addition to its departure angle) may vary depending on the particular implementation. By way of example, the slanted surface 230 may extend from the receiver coupling 225 to approximately a central portion of the inner wall as shown in FIGS. 2A–2D (e.g., the central portion corresponding to the intersection between the receiving portion 240 and holding portion 250 of the toner supply receiver 200, and is approximately 40–60% of the length of the inner wall).

Additionally, it should be appreciated that the degree of the departure angle (e.g., the less than about 45 degree departure angle shown in FIG. 2A) determines the amount of rotation the toner bottle 402 will undergo for a particular insertion distance. In this regard, the departure angle may cause more rotation during an initial insertion step (e.g., the steps shown in FIGS. 2A and 2B), and gradually taper off during later insertion steps (e.g., the steps shown in FIGS. 2C and **2*d***). Preferably, the departure angle is set as small as possible, in view of the increase in length corresponding to a decrease in the departure angle. Thus, the particular departure angle will vary based on differing implementation requirements.

According to one embodiment of the present invention, the toner supply receiver 200 may also be configured to open/close a shutter supply mechanism 270 on toner bottle 402. By way of example, shutter supply mechanism 270 may include a slide which engages an abutting surface of receiving portion 240 of toner supply receiver 200 when properly aligned therewith. The abutting surface of receiving portion 240 thus slides the shutter supply mechanism 270, thereby exposing toner opening 260 for supplying toner to the toner supply unit. Preferably, the shutter supply mechanism 270 is closed upon removal of the toner bottle 402, which prevents any residual toner from spilling out of the toner bottle 402.

The aforementioned embodiments thus allow an operator to easily replace a toner bottle in a toner supply unit. Furthermore, the aforementioned embodiments do not necessarily require that a special shape toner bottle be used, and thus can be used with commercially available toner bottles. Further advantages and features will be readily apparent to one of ordinary skill in the art after reading this disclosure.

The foregoing description of preferred embodiments of the invention has been presented for purposes of illustration and description. It is not intended to be exhaustive or to limit the invention to the precise form disclosed, and modifications and variations are possible in light in the above teachings or may be acquired from practice of the invention, such as a multi-bottle configuration (e.g., for a color photocopier) with a plurality of toner supply units and/or toner supply receivers. The aspects of the embodiments may be combined with one another. The embodiments were chosen and described in order to explain the principles of the invention and a practical application to enable one skilled in the art to utilize the invention in various embodiments and with various modifications are suited to the particular use contemplated.

What is claimed is:

1. An image forming apparatus, comprising:

a toner supply receiver comprising:

an opening configured to receive a toner bottle, the toner bottle having a toner bottle projection and a shutter supply mechanism provided on the toner bottle so as to open or close an opening along the toner bottle projection; and a base portion having a receiver coupling configured to releasably retain the toner bottle, and an inner wall including an insertion guide surface configured to engage the toner bottle projection so as to cause rotation of the toner bottle relative to the base portion as the toner bottle is inserted into the toner supply receiver to thereby align the toner bottle with the receiver coupling in a predetermined manner; and an image formation unit configured to form an image on an image-transferring member using toner from the toner supply receiver.

2. The image forming apparatus of claim 1, wherein the insertion guide surface comprises a slanted surface so as to align the toner supply receiver with the toner bottle in a predetermined orientation by gradually rotating the toner bottle along the inner wall.

3. The image forming apparatus of claim 2, wherein the slanted surface has a depth corresponding to a height of the toner bottle projection on the toner bottle.

4. The image forming apparatus of claim 2, wherein the slanted surface has a length along the inner wall sufficient to rotate the toner bottle up to at least 45 degrees.

5. The image forming apparatus of claim 2, wherein the slanted surface has a length along the inner wall sufficient to rotate the toner bottle up to at least 90 degrees.

6. The image forming apparatus of claim 2, wherein the slanted surface has a length along the inner wall sufficient to rotate the toner bottle up to at least 180 degrees.

7. The image forming apparatus of claim 2, wherein the slanted surface has a length along the inner wall only sufficient to rotate the toner bottle up to less than 360 degrees.

8. The image forming apparatus of claim 2, wherein the slanted surface extends from the receiver coupling to approximately a central portion of the inner wall.

9. The image forming apparatus of claim 2, wherein the slanted surface has an increased circumferential length circumferentially along the inner wall in a direction toward the receiver coupling.

10. The image forming apparatus of claim 1, wherein the base portion comprises a receiving portion and a holding portion, the receiving portion having a smaller diameter than the holding portion, and wherein the slanted surface extends within the receiving portion.

11. The image forming apparatus of claim 1, wherein the insertion guide surface comprises a grooved surface.

12. The image forming apparatus of claim 1, wherein the insertion guide surface causes alignment of the toner bottle with the receiver coupling in the predetermined manner for insertion of the toner bottle in any rotational position relative to the opening.

13. A method of refilling toner in a toner supply receiver in an image forming apparatus, the toner supply receiver including a base portion having a receiver coupling for receiving a toner bottle, the toner bottle having a toner bottle projection and a shutter supply mechanism provided on the toner supply bottle so as to open or close an opening along the toner bottle projection, the base portion including an inner wall having an insertion guide surface configured to engage the toner bottle surface, the method comprising:

inserting the toner bottle into the base portion;

while the toner bottle is being inserted into the base portion, sliding the toner bottle along the insertion guide surface to cause the toner bottle to rotate relative to the base portion and align the toner bottle relative to the base portion in a predetermined manner;

engaging an abutting surface of the toner supply receiver coupling with the shutter supply mechanism;

sliding the shutter supply mechanism, to expose the toner opening along the toner bottle projection; and releasably coupling the toner bottle to the base portion.

14. The method of claim 13, further comprising rotating the base portion with the toner bottle coupled to the base portion.

15. The method of claim 13, wherein the insertion guide surface comprises a slanted surface so as to align the toner supply receiver with the toner bottle in a predetermined orientation by gradually rotating the toner bottle along the inner wall.

16. The method of claim 15, wherein the slanted surface has a depth corresponding to a height of the toner bottle projection on the toner bottle.

17. The method of claim 15, wherein the slanted surface causes alignment of the toner bottle relative to the base portion in the predetermined manner for initial insertion of the toner bottle in any rotational position relative to the base portion.

18. The method of claim 15, wherein the slanted surface has a length along the inner wall only sufficient to rotate the toner bottle up to less than 360 degrees.

19. An image forming apparatus, comprising:

means for aligning a toner bottle being inserted into a toner supply mechanism, said means for aligning the toner bottle being relative to the toner supply mechanism during insertion of the toner bottle, said means including a guide surface configured to engage a toner bottle projection of the toner bottle;

means for releasably coupling the toner bottle to the toner supply mechanism;

means for opening or closing an opening along the toner bottle projection; and means for forming an image on an image-transferring member using toner from the toner supply mechanism.

20. The image forming apparatus of claim 19, wherein the guide surface comprises a slanted surface so as to align the toner supply mechanism with the toner bottle in a predetermined orientation by gradually rotating the toner bottle along the inner wall.

21. An image forming apparatus, comprising:

a toner supply receiver comprising:

an opening configured to receive a toner bottle; and a base portion having a receiver coupling configured to releasably retain the toner bottle, and an inner wall including a grooved insertion guide surface configured to cause rotation of the toner bottle relative to the base portion as the toner bottle is inserted into the toner supply receiver to thereby align the toner bottle with the receiver coupling in a predetermined manner; and an image formation unit configured to form an image on an image-transferring member using toner from the toner supply receiver.

* * * * *